US010124225B2

(12) United States Patent
Maeng et al.

(10) Patent No.: US 10,124,225 B2
(45) Date of Patent: Nov. 13, 2018

(54) HOLDER FOR GOLF CLUBS

(71) Applicants: Seop Maeng, Seongnam-si (KR); Seoe Young Maeng, Seoul (KR)

(72) Inventors: Seop Maeng, Seongnam-si (KR); Seoe Young Maeng, Seoul (KR)

( * ) Notice: Subject to any disclaimer, the term of this patent is extended or adjusted under 35 U.S.C. 154(b) by 181 days.

(21) Appl. No.: 15/016,403

(22) Filed: Feb. 5, 2016

(65) Prior Publication Data

US 2016/0317887 A1 Nov. 3, 2016

(30) Foreign Application Priority Data

May 1, 2015 (KR) ..... 10-2015-0062250

(51) Int. Cl.
*A63B 60/62* (2015.01)

(52) U.S. Cl.
CPC ..... *A63B 60/62* (2015.10); *A63B 2209/08* (2013.01); *A63B 2209/10* (2013.01)

(58) Field of Classification Search
CPC .. A63B 60/62; A63B 2209/08; A63B 2209/10
See application file for complete search history.

(56) References Cited

U.S. PATENT DOCUMENTS 210,759 A * 12/1878 Debacher ..... A45C 13/04 150/112
1,052,805 A * 2/1913 Vom Eigen ..... A45C 13/06 292/13
1,784,748 A * 12/1930 Quigan ..... A45C 13/04 150/107
1,952,131 A * 3/1934 Hiering ..... A45C 13/06 150/104
1,977,855 A * 10/1934 McCabe ..... B42F 13/0026 150/115
2,013,706 A * 9/1935 Wiesenfeld ..... A44B 19/22 206/527
2,055,238 A * 9/1936 Merk ..... A45C 13/06 150/123
5,131,700 A * 7/1992 Mannato ..... A45C 13/10 292/204

* cited by examiner

*Primary Examiner* — Tri Mai
(74) *Attorney, Agent, or Firm* — Millen, White, Zelano & Branigan, P.C.; William Nixon

(57) ABSTRACT

A holder for golf clubs with a hanger is disclosed. The holder for golf clubs includes a holder main body including cut parts divisionally formed in the longitudinal direction and opened and closed and opening and closing operating units installed within the holder main body and opened and closed to the left and right and receiving force acting to spread the cut parts, a pair of shape rods disposed inside the edges of the cut parts of the holder main body, contacting each other, and including a pair of opening and closing protrusions protruding upwards from the centers of the shape rods, and a hanger including a pair of fixing protrusions to fix the pair of opening and closing protrusions of the shape rods and detachably fixed to the pair of opening and closing protrusions, thereby allowing the holder main body to be conveniently opened/closed and having a simple structure.

9 Claims, 13 Drawing Sheets

HOLDER FOR GOLF CLUBS

BACKGROUND OF THE INVENTION

Field of the Invention

The present invention relates to a holder for golf clubs with a hanger, and more particularly to a holder for golf clubs in which opening and closing protrusions protrude upwards from the centers of the edges of opening and closing operating units to open and close a holder main body to receive a club head, and a hanger including a fixing protrusion formed at at least one side thereof corresponding to the opening and closing protrusions of the holder main body and detachably fixed to the opening and closing protrusions of the holder main body is provided to open and close the holder main body, so that, when the hanger is separated from the opening and closing protrusions, the holder main body is opened and, when the hanger is attached to the opening and closing protrusions, the holder main body is locked so as to conveniently open and close the holder main body and to have a simple structure.

Description of the Related Art

In general, various shapes of protective covers for golf clubs are proposed. Most protective covers for golf clubs are formed of fabrics and inserted into heads of golf clubs G. Among these protective covers, a protective cover H, as exemplarily shown in FIG. 10, is formed in the shape of a sack so as to surround both a head G2 and the upper part of a shaft G1 of a golf club G, cut in the length direction so that the head G2 and the shaft G1 of the golf club G are easily inserted into the protective cover H through the cut part, and a slide fastener Z is attached to the cut part. Through such a structure, when the slide fastener Z attached to the protective cover H is opened, the golf club G is inserted into the protective cover H and then the slide fastener Z is closed, the protective cover H may protect the head G2 and the upper part of the shaft G1. However, in case of most protective covers H, the slide fastener Z needs to be opened and closed using both hands whenever in use, thus causing trouble and inconvenience.

In order to solve such a problem, Korean Patent Application No. 10-2012-0144711 titled 'Golf club holder', filed by the present applicant, proposes a method in which, in a main body of a golf club holder including a pair of opening and closing plates, hook-type fixing portions are formed at one end of one opening and closing plate and a fixing protrusion is formed at the other end of the other opening and closing plate so that the golf club holder is opened and closed by coupling the fixing portions and the fixing protrusion with each other. However, since the hook-type fixing portions formed at one end of the opening and closing plate are disposed at the inside of the golf club holder and may thus contact the outer surface of a club shaft received in the golf club holder and damage the outer surface of the club shaft, the golf club holder may have poor marketability.

PRIOR ART DOCUMENT

Patent Document

Korean Patent Registration No. 10-1369530

SUMMARY OF THE INVENTION

Therefore, the present invention has been made in view of the above problems, and it is an object of the present invention to provide a holder for golf clubs in which a pair of opening and closing protrusions extending in the length direction and protruding upwards is formed at both edges of opening and closing operating units of a holder main body to receive a club head, and a hanger including a fixing protrusion formed at at least one side thereof corresponding to the opening and closing protrusions and detachably fixed to the opening and closing protrusions of the holder main body is installed, so that, when locking between the hanger and the opening and closing protrusions is released, the opening and closing operating parts of the holder main body receives force acting to spread the opening and closing operating parts and are opened to insert or withdraw a club head into or from the holder main body and, when the holder main body is closed and the fixing protrusions of the hanger are fixed to the opening and closing protrusions, the holder main body is closed so as to conveniently open and close the holder main body even by only one hand and to have a simple structure.

In accordance with the present invention, the above and other objects can be accomplished by the provision of a holder for golf clubs including a holder main body including cut parts divisionally formed in the longitudinal direction so as to receive a club head of a golf club and opening and closing operating units installed within the holder main body to open and close the cut parts to the left and right about a hinge shaft and receiving force acting to spread the opening and closing operating units, opening and closing protrusions protruding upwards from the centers of the front surfaces of the edges of the opening and closing operating units of the holder main body, contacting each other, and a hanger including fixing protrusions to grasp the opening and closing protrusions of the shape rods and detachably fixed to the opening and closing protrusions.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
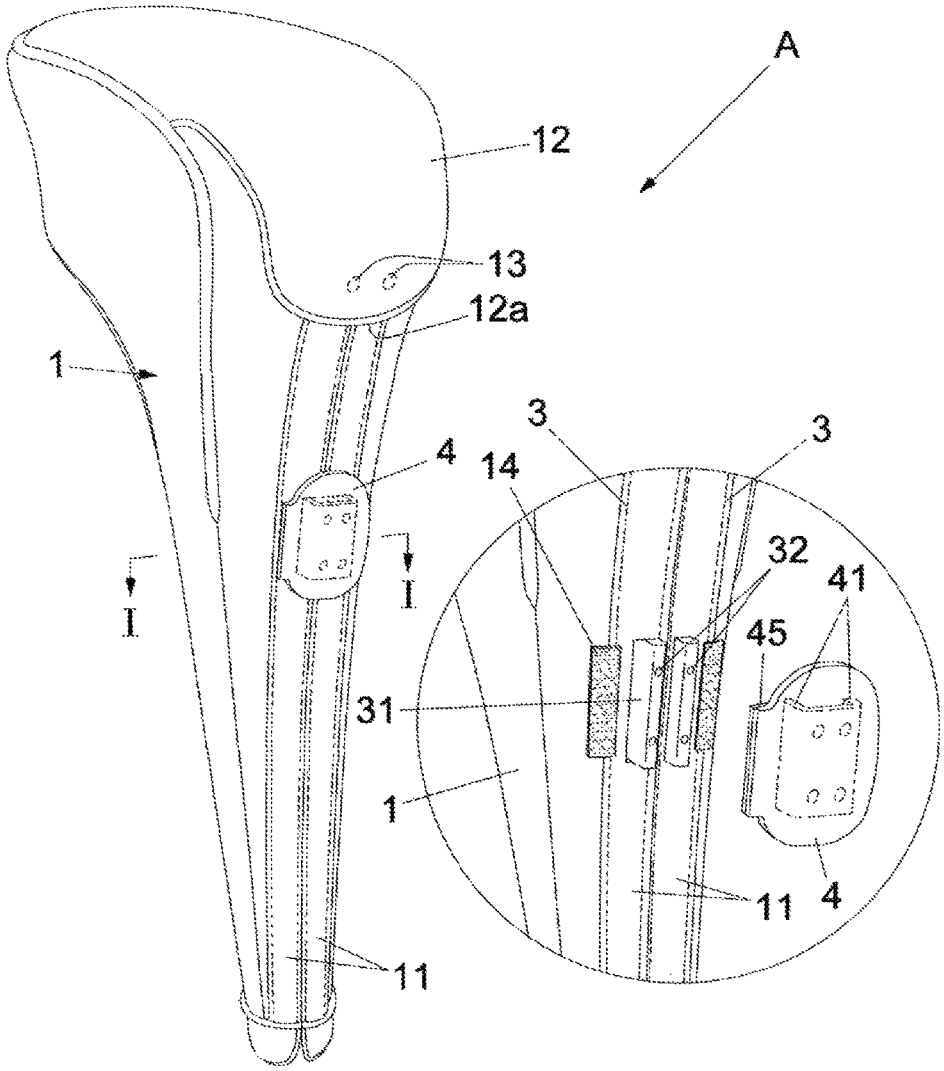
FIG. 1 is a perspective view of a holder for golf clubs with a hanger in accordance with one embodiment of the present invention.

Hereinafter, preferred embodiments of the present invention will be described with reference to the annexed drawings.

A holder A for golf clubs provided with a hanger in accordance with one embodiment of the present invention, as shown in FIG.'s 1 to 6, includes a holder main body 1 including cut parts 11 divisionally formed in the longitudinal direction and opened and closed so as to receive a club head H of a golf club and opening and closing operating units 2 disposed within the holder main body 1 to open and close the cut parts 11 to the left and right and receiving force acting to spread the opening and closing operating units 2 about a hinge shaft, shape rods 3 disposed at the edges of the cut parts 11 of the holder main body 1, contacting each other, and including opening and closing protrusions 31 protruding upwards from the centers of the shape rods 3, and a hanger 4 including fixing protrusions 41 corresponding to the opening and closing protrusions 31 of the shape rods 3 and caught and grasped by the opening and closing protrusions 31 so that the opening and closing protrusions 31 are detachably fixed to the hanger 4.

The holder main body 1 includes the cut parts 11 divided from each other in the longitudinal direction so as to receive the club head H of a general golf club, and the club head H of the golf club is received within or withdrawn from the holder main body 1 by opening and closing the cut parts 11 of the holder main body 1. An upper holder lid 12, which moves according to the opening and closing operation of the cutting parts 11 and thus protects the inner surface of the holder main body 1, is installed above the cut parts 11 of the holder main body 1. Since the upper holder lid 12 has a lower end part 12*a* which covers the upper portions of the cut parts 11 of the holder main body 1 and protects the inside of the holder main body 1 even if the cut parts 11 of the holder main body 1 are opened, the upper holder lid 12 may shield the inside of the holder main body 1 and thus protect the holder main body 1 and, thereby, high product quality may be maintained.

Lid magnets 13 are installed at the lower portion of the upper holder lid 12 and correspond to upper magnets 33 fixed to the upper portions of the shape rods 3. Hook and loop tapes 14 are attached to the outer surface of the holder main body 1 outside of the opening and closing protrusions 31, and detachably fix the hanger 4 to the holder main body 1 in cooperation with hook and loop tapes 45 attached to the inner surface of the hanger 4 grasping and fixing the opening and closing protrusions 31.

Figure 3A:
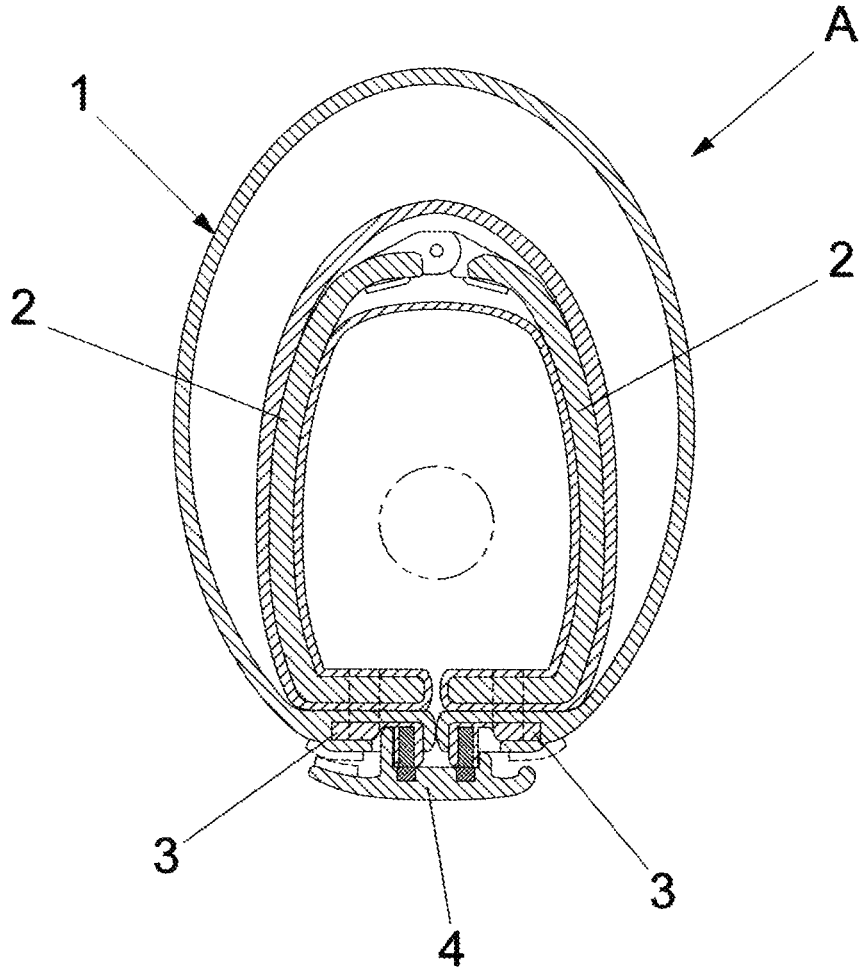
FIG. 3A is a longitudinal-sectional view of the holder for golf clubs in the closed state, taken along the line I-I of FIG. 1.
Figure 3B:
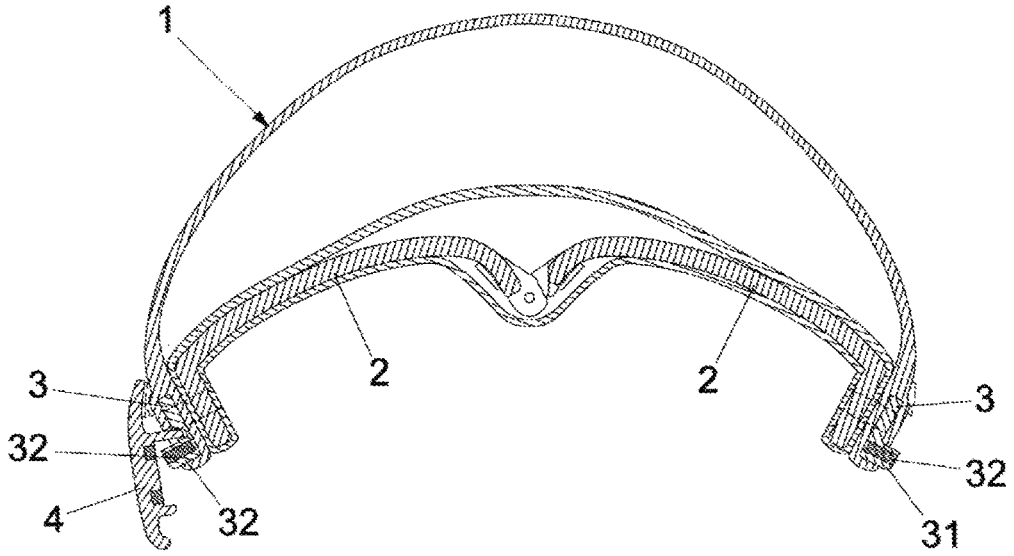
FIG. 3B is a longitudinal-sectional view of the holder for golf clubs in the opened state, taken along the line I-I of FIG. 1.

The opening and closing operating units 2 to apply elastic supporting force in a direction of opening the cut parts 11 at all times are installed at the inside of the holder main body 1. FIGS. 3A and 3B schematically illustrate such opening and closing operating units 2. One exemplary structure of the opening and closing operating units 2 has been described in Korean Patent Registration No. 10-1369530 filed by the applicant and a detailed description of the opening and closing operating units 2 will thus be omitted in the present invention.

Figure 4:
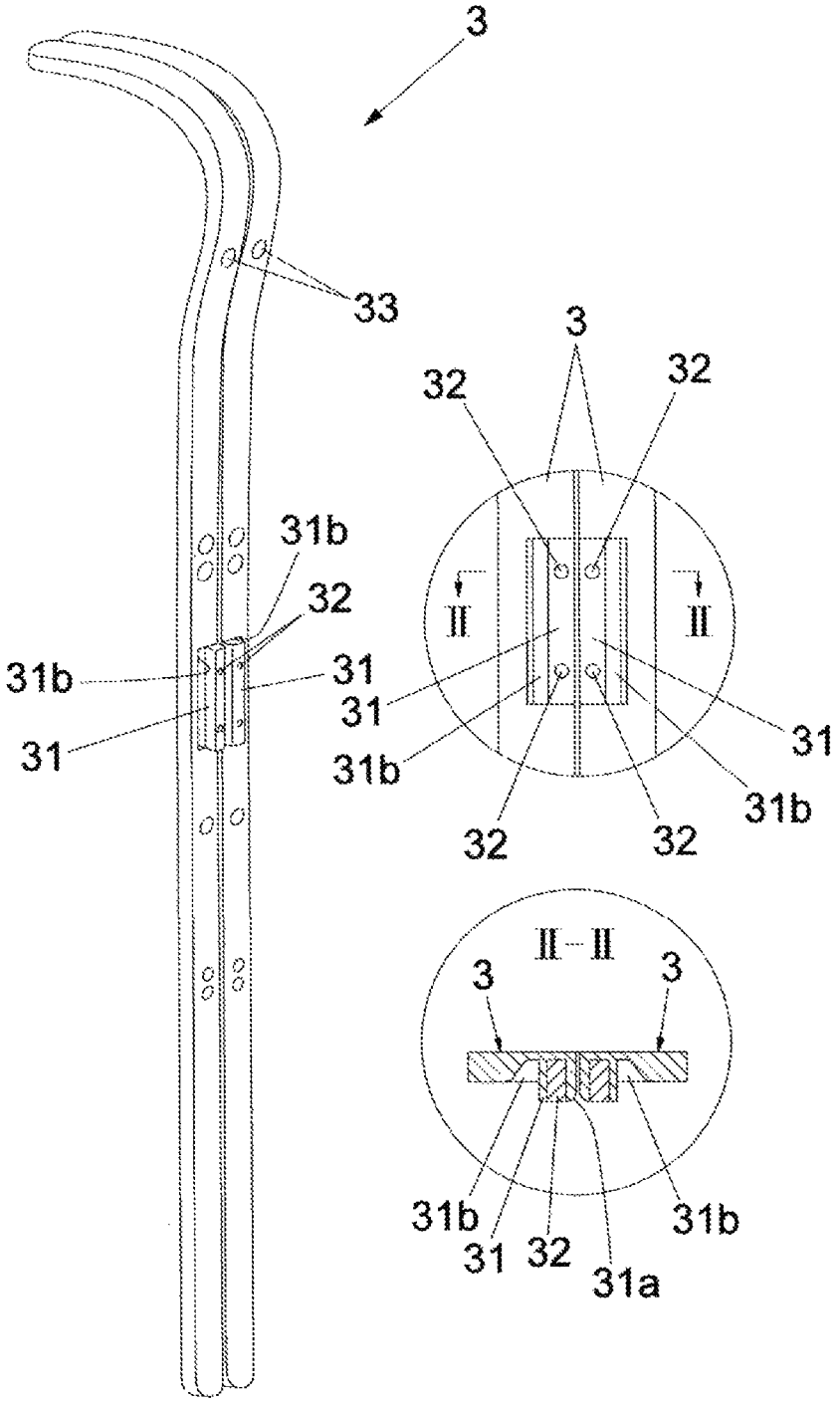
FIG. 4 is a perspective view illustrating shape rods having opening and closing protrusions in accordance with one embodiment of the present invention.

The shape rods 3 are fixed to the edges of the inner surfaces of the cut parts 11, installed in the longitudinal direction along the edges of the cut parts 11, and formed so as to be fitted with the cross-section of the cut parts 11. The shape rods 3 may be formed to have various shapes according to the shapes of the club head H received in the holder main body 1 and FIG. 4 illustrates shapes rods 3 in accordance with one embodiment. Although this embodiment describes the shape rods 3 including the opening and closing protrusions 31 as elements provided separately from the opening and closing operating units 2 for convenience, the disclosure is not limited thereto and the shape rods 3 may be detachably attached to opening and closing wings of the opening and closing operating units 2 or the opening and closing protrusions 31 may be formed integrally with the edges of the opening and closing wings.

As exemplarily shown in FIG. 4, the opening and closing protrusions 31 protruding upwards are formed at the centers of the shape rods 3 and fixing magnets 32 are attached to the surfaces of the opening and closing protrusions 31.

In this embodiment, the fixing magnets 32 of the shape rods 3 serve to locate the hanger 4 at a designated position in cooperation with corresponding fixing magnets 42 attached to the hanger 4. Further, a total of four fixing magnets 32, two of which are spaced from each other by a designated interval and disposed on each opening and closing protrusion 31, are attached to the opening and closing protrusions 31 of the shape rods 3 and thus execute a function of correcting staggered arrangement of a pair of shape rods 3 into parallel arrangement in cooperation with four corresponding fixing magnets 42 of the hanger 4. That is, problems generated if there are no magnets, i.e., distortion and staggering of two shape rods 3, fixed to the edges of the inner surfaces of the cut parts 11 and forming the edges of the cut parts 11, or spreading of the shape rods 3 at one side, may be prevented using strong magnetic attraction between magnets. In the present invention, since four fixing magnets 32, two of which are spaced from each other by a designated interval and disposed on each opening and closing protrusion 31, are fixed to the two shape rods 3 and the corresponding fixing magnets 42 are fixed to the inner surface 40 of the hanger 4 between a pair of fixing protrusions 41 at positions corresponding to the fixing magnets 32, even if the adjacent shape rods 3 are spread or distorted, the fixing magnets 32 of the respective shape rods 3 are strongly and coplanarly attached to the corresponding fixing magnets 42 on the inner surface 40 of the hanger 4 and, thus, staggering of the shape rods 3 due to distortion or spreading of the shape rods 3 at one side is naturally corrected and the shape rods 3 are arranged on the same plane. Although this embodiment describes two fixing magnets 32 as being installed on each of the opening and closing protrusions 31, one fixing magnet may be installed on each of the opening and closing protrusions 31.

The upper magnets 33 are fixed to the upper portions of the shape rods 3 and, when the cut parts 11 are locked, the lid magnets 13 of the holder main body 1 are attached to the upper magnets 33 and thus fix the upper holder lid 12 of the holder main body 1.

The outer upper corners 31*c* of the opening and closing protrusions 31 of the shape rods 3 are rounded and, thus, the opening and closing protrusions 31 may lift the fixing protrusions 41 of the hanger 4 and be inserted into the hanger 4 without being caught by the fixing protrusions 41 and attachment of the hanger 4 to the shape rods 3 may be easily executed.

The hanger 4 includes a pair of fixing protrusions 41 having a width W2 slightly greater than the width W1 of a pair of the opening and closing protrusions 31 of the shape rods 3, and the corresponding fixing magnets 42 attached to the inner surface of the hanger 4 between the fixing protrusions 41 at positions corresponding to the fixing magnets 32 so as to be attached to the fixing magnets 32 using magnetic attraction therebetween.

The fixing protrusions 41 and the corresponding fixing magnets 42 are fixed to the inner surface of the hanger 4 contacting the opening and closing protrusions 31, and bending parts 43 extending outwards from the fixing protrusions 41 are formed on the outer surface of the hanger 4.

Figure 6A:
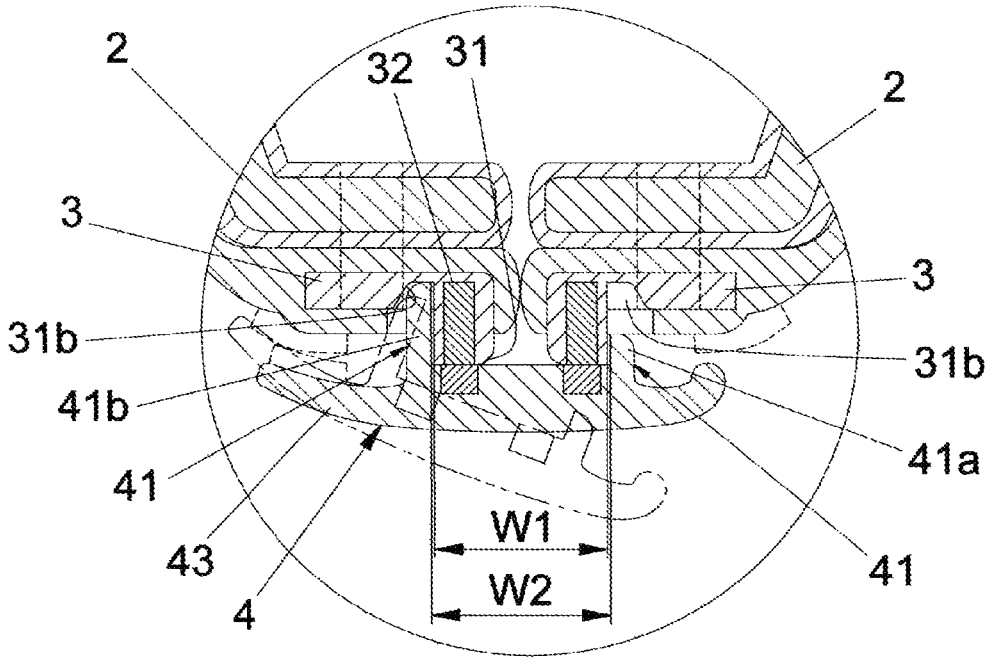
FIG. 6A is a view illustrating the opening and locking operation of the holder for golf clubs of FIG. 1.
Figure 6B:
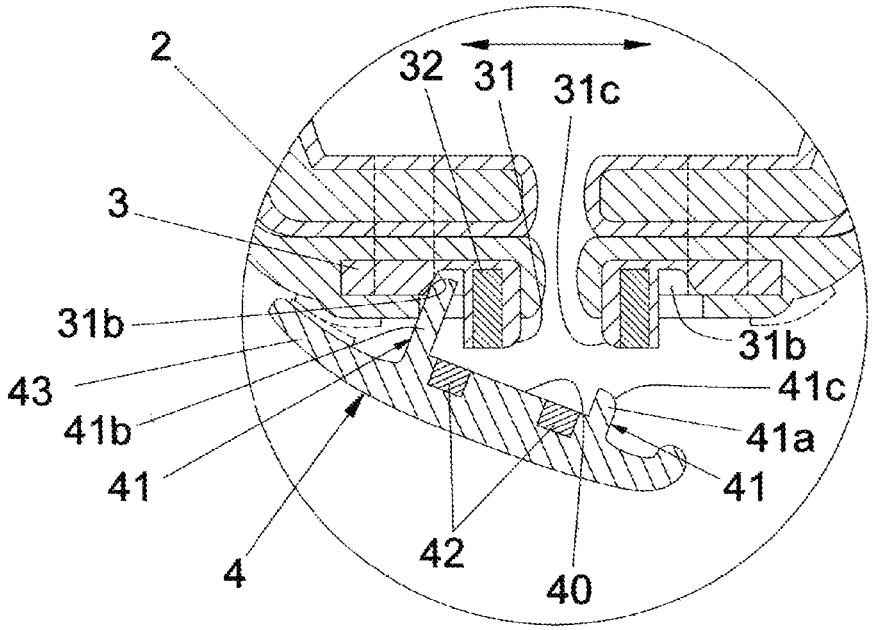
FIG. 6B is another view illustrating the opening and locking operation of the holder for golf clubs of FIG. 1.
Figure 6C:
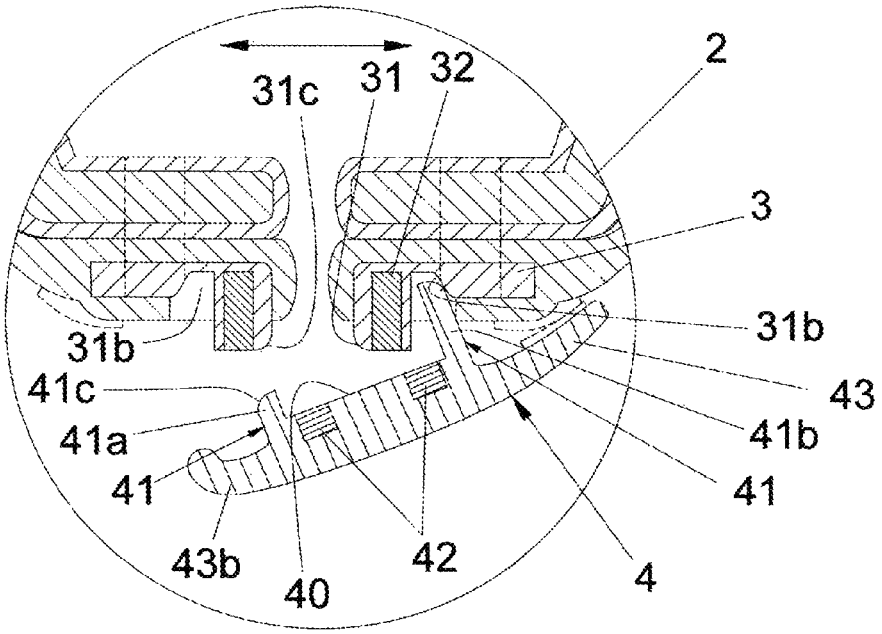
FIG. 6C is a view illustrating the opening and locking operation of the holder for golf clubs of FIG. 1.
Figure 7:
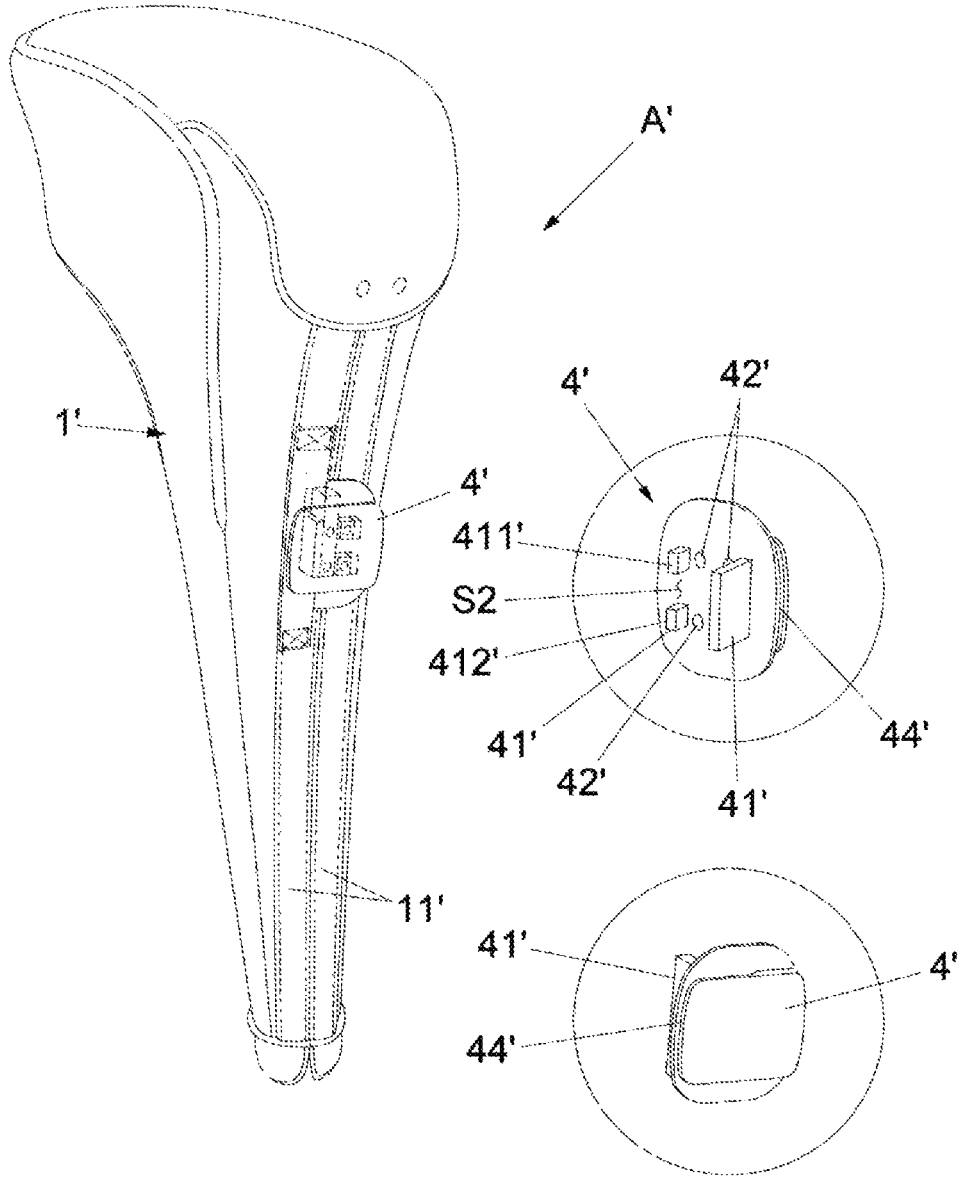
FIG. 7 is a perspective view of a holder for golf clubs with a hanger in accordance with another embodiment of the present invention.

Among a pair of the fixing protrusions 41 formed on the inner surface of the hanger 4, one fixing protrusion 41 having a greater length than the other fixing protrusion 41 is defined as a support fixing protrusion 41*b*, and insertion grooves 31*b*, into which the end of the support fixing protrusion 41*b* is inserted, are formed at portions of the shape rods 3 outside the opening and closing protrusions 31. When the support fixing protrusion 41*b* of the hanger 4 is inserted into and fixed in the insertion groove 31*b*, one side of the hanger 4 is easily lifted by the leverage principle using the support fixing protrusion 41*b* inserted into the insertion groove 31*b* as a lever, the hanger 4 is fixed and thus vertical movement or horizontal movement of the hanger 4 is prevented, and the hanger 4 is easily fixed to the shape rods 3 (more broadly, the hanger 4 is easily fixed to the holder main body 1). Further, the holder main body 1 may be opened by lifting the end of a short bending part 43*b* of the hanger 4. Further, as exemplarily shown in FIG. 6C, if the position of the long bending part 43 is rotated by 180 degrees and the hanger 4 is fixed to the shape rods 3, the holder main body 1 may be opened by pressing the long bending part 43 at the other side or lifting the short bending part 43*b* of the hanger 4.

The outer corners 41*c* of the fixing protrusions 41 are rounded and may easily close the holder main body 1 in cooperation with the upper corners 31*c* of the opening and closing protrusions 31 of the shape rods 3.

In this embodiment, since four corresponding fixing magnets 42 of the hanger 4 are provided, defects, such as staggering or spreading of a pair of the shape rods 3, may be corrected by strong magnetic attraction between the corresponding fixing magnets 42 attached to the hanger 4 and the fixing magnets 32 attached to the shape rods 3.

Figure 5A:
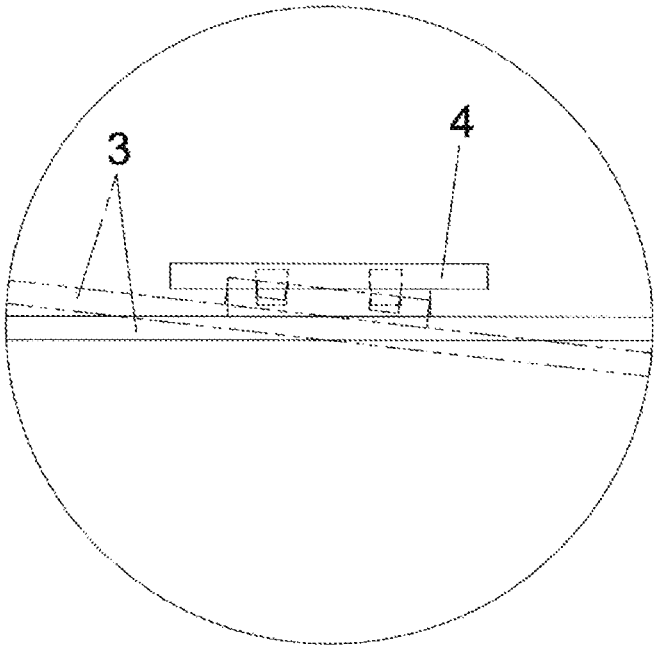
FIG. 5A is a view illustrating operation of the hanger to correct the shape rods which are staggered vertically.
Figure 5B:
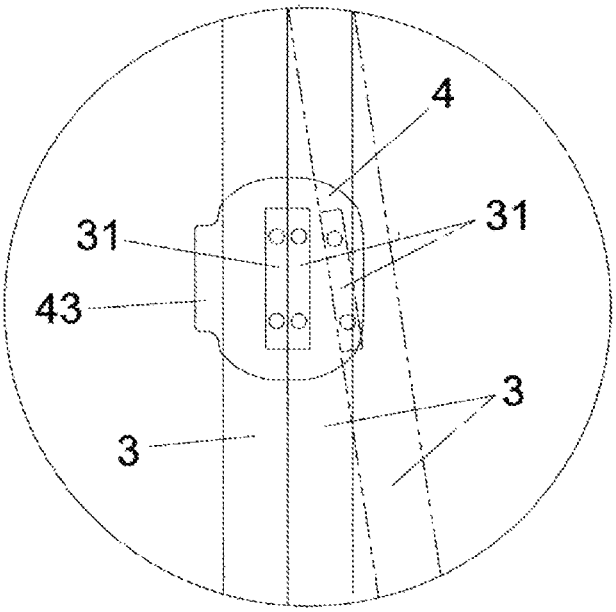
FIG. 5B is a view illustrating operation of the hanger to correct the shape rods which are spread horizontally.

As exemplarily shown in FIG. 5A, although the shape rods 3 in a pair are not coplanar and are staggered vertically, as shown by an alternate long and two short dashes line, the respective corresponding fixing magnets 42 of the hanger 4 are coplanar, attract the fixing magnets 32, fixed to the opening and closing protrusions 31 of the staggered shape rods 3, in the direction of the corresponding fixing magnets 42, and fix the fixing magnets 32 to the same plane as the corresponding fixing magnets 42, thereby correcting misarrangement of the shape rods 3, i.e., vertical staggering of the shape rods 3. Further, as exemplarily shown in FIG. 5B, although the shape rods in a pair are spread, as shown by an alternate long and two short dashes line, spreading of the shape rods 3 is corrected by the corresponding fixing magnets 42 of the hanger 4 and may thus be changed to a parallel state.

Hereinafter, operation of the holder A for golf clubs in accordance with the present invention, having the above-described configuration, will be described in detail.

Figure 2A:
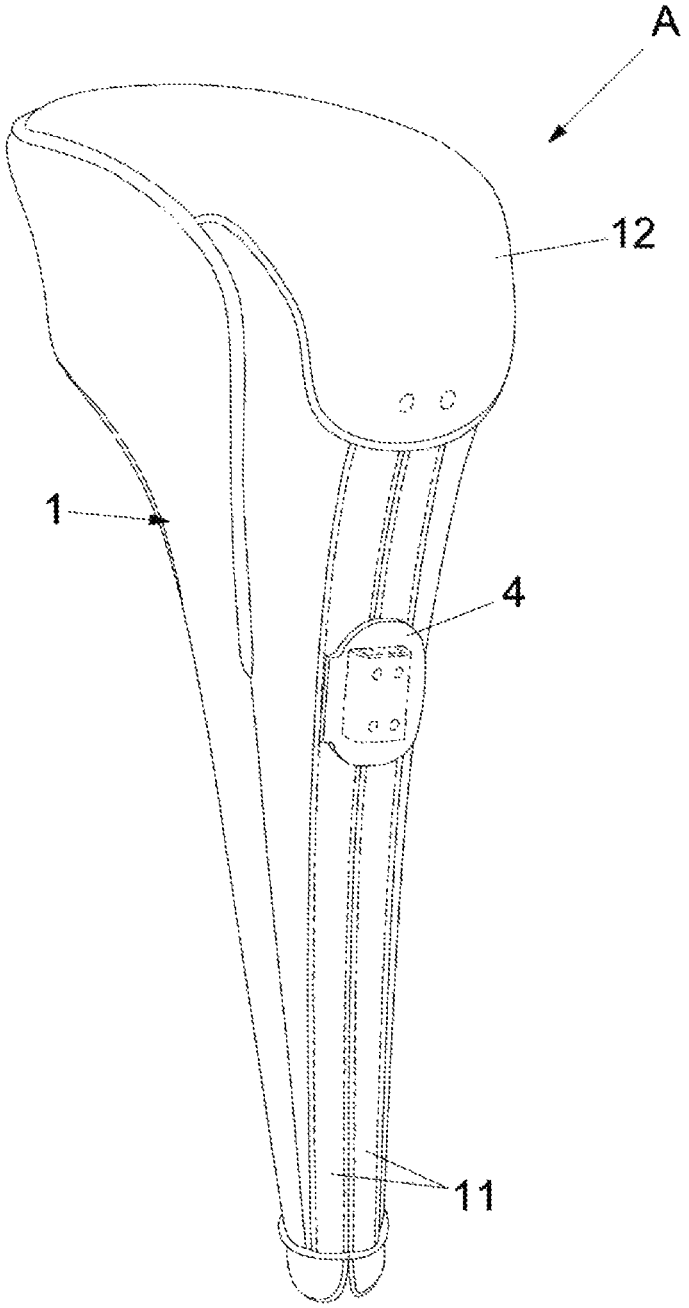
FIG. 2A is a perspective view of the holder for golf clubs of FIG. 1 in a locked state.
Figure 2B:
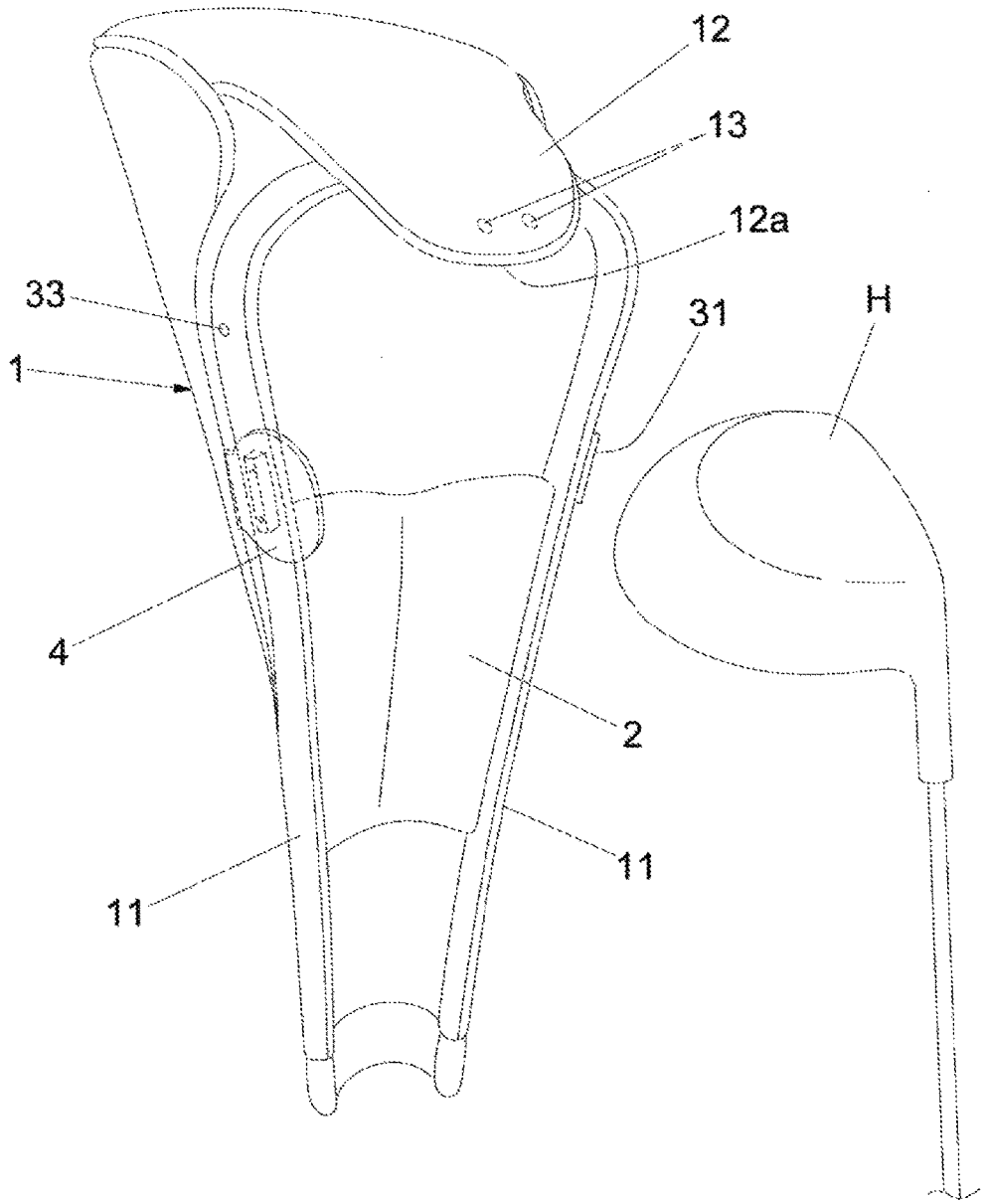
FIG. 2B is a perspective view of the holder for golf clubs of FIG. 1 in an opened state.

In a state in which a club head H is received in the holder main body 1 and the holder main body 1 is closed by the hanger 4 (shown in FIG. 2A), when the bending part 43 is pressed under the condition that the support fixing protrusion 41*b* of the hanger 4 is inserted into the insertion groove 31*a*, the bending part 43 is pressed and contacts the outer surface of the holder main body 1, the fixing magnets 32 and the corresponding fixing magnets 42 magnetically attached to each other are separated from each other, and the bending part 43 at the other side is lifted. Therefore, simultaneously with separation of the fixing magnets 32 and the corresponding fixing magnets 42 magnetically attached to each other, the fixing protrusion 41 formed integrally with the bending part 43 at the other side is lifted and, when the fixing protrusion 41 passes by the upper end of the opening and closing protrusion 31, the cut parts 11 of the holder main body 1 are opened by the opening and closing operating units 2, installed within the holder main body 1 and applying force acting to open the cut parts 11 (shown in FIGS. 2B, 3B and 6B).

Therefore, if a user desires to withdraw the received club head H from the holder main body 1 and then to close the holder main body 1, when the user applies force to the holder main body 1 while grasping the holder main body 1, the spread cut parts 11 move in the direction of contacting each other. Then, the upper rounded corners 31*a* of the opening and closing protrusions 31 contact the outer rounded corners 41*a* of the fixing protrusions 41 of the hanger 4 and smoothly lift one fixing protrusion 41 of the hanger 4. When the opening and closing protrusion 31 passes by the lower surface of the hanger 4, one fixing protrusion 41 of which is lifted, the hanger 4 is rotated by magnetic force between the fixing magnets 32 fixed to the opening and closing protrusion 31 and the corresponding fixing magnets 42 fixed to the fixing protrusion 41 and, when the moving opening and closing protrusion 31 is adjacent to the other opening and closing protrusion 31, rotation of the hanger 4 is finished, the fixing protrusion 41 grasps the opening and closing protrusion 31 and, thus, the holder main body 1 is firmly closed.

As described above, the holder A for golf clubs in accordance with this embodiment of the present invention includes the shape rods including the opening and closing protrusions protruding upwards from the centers thereof and the hanger including the fixing protrusions corresponding to the opening and closing protrusions of the shape rods so as to fix the opening and closing protrusions, and is opened and closed by fixing the hanger to the shape rods and releasing the hanger from the shape rods. When fixation of the fixing protrusions of the hanger to the opening and closing protrusions is released, the cut parts of the holder main body receive force acting to spread the cut parts at the moment of time when the fixing protrusions are separated from the opening and closing protrusions and are automatically opened so that a user may withdraw and insert a club head from or into the holder main body and, when the opened cut parts are closed and the fixing protrusions of the hanger are fixed to the opening and closing protrusions, the holder is closed so that the user may open and close the holder for golf clubs even by only one hand, thereby allowing the holder for golf clubs to be conveniently opened and closed and to have a simple structure.

In a holder A' for golf clubs in accordance with another embodiment of the present invention, a method of pushing a hanger 4' so as to more conveniently operate the hanger 4' is applied.

The holder A' for golf clubs in accordance with this embodiment of the present invention, as exemplarily shown in FIGS. 7 to 9B, includes a holder main body 1' including cut parts 11' divisionally formed in the longitudinal direction and opened and closed so as to receive a club head of a golf club and opening and closing operating units (being the same as those of the earlier embodiment and thus not shown) disposed within the holder main body 1' to open and close the cut parts 11 to the left and right and receiving force acting to spread the opening and closing operating units about a hinge shaft, a pair of shape rods 3' disposed at the edges of the cut parts 11' of the holder main body 1', contacting each other, and including opening and closing protrusions 31' protruding upwards from the centers of the shape rods 3, and a hanger 4' including fixing protrusions 41' corresponding to the opening and closing protrusions 31' of the shape rods 3', grasping the opening and closing protrusions 31', and vertically sliding to be detachably fixed to the opening and closing protrusions 31'.

Figure 8:
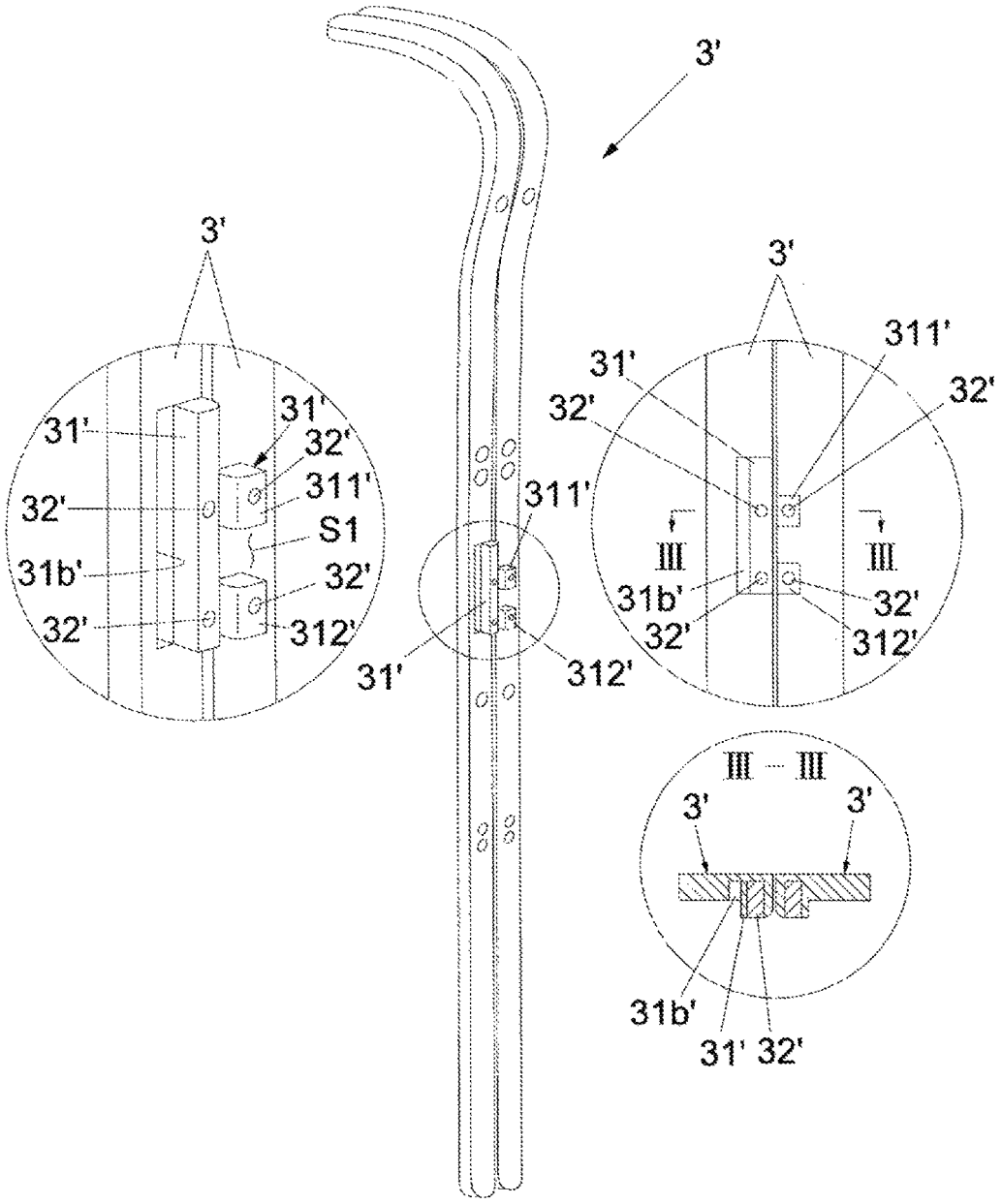
FIG. 8 is a perspective view illustrating shape rods having opening and closing protrusions in accordance with another embodiment of the present invention.
Figure 9A:
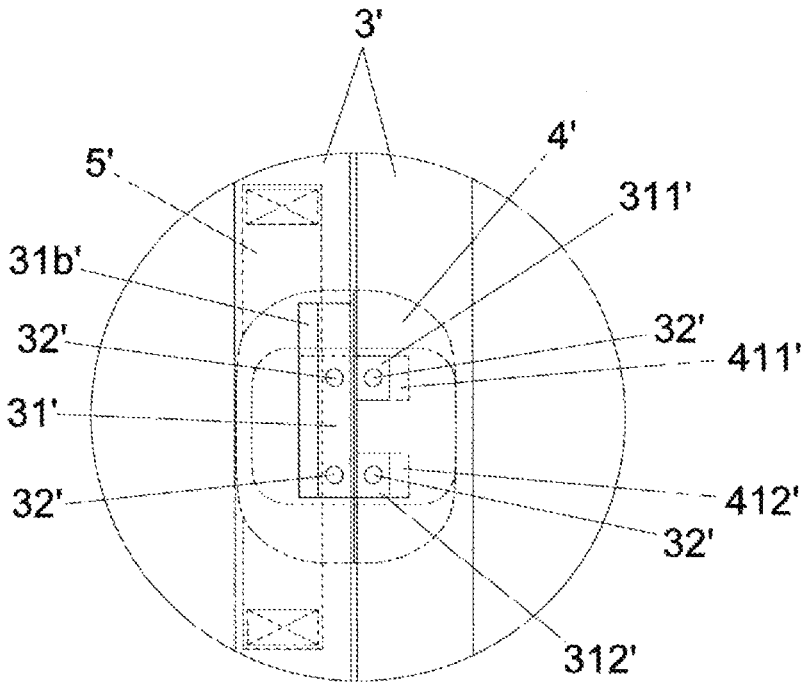
FIG. 9A is a schematic front view illustrating the hanger in accordance with another embodiment of the present invention after operation.
Figure 9B:
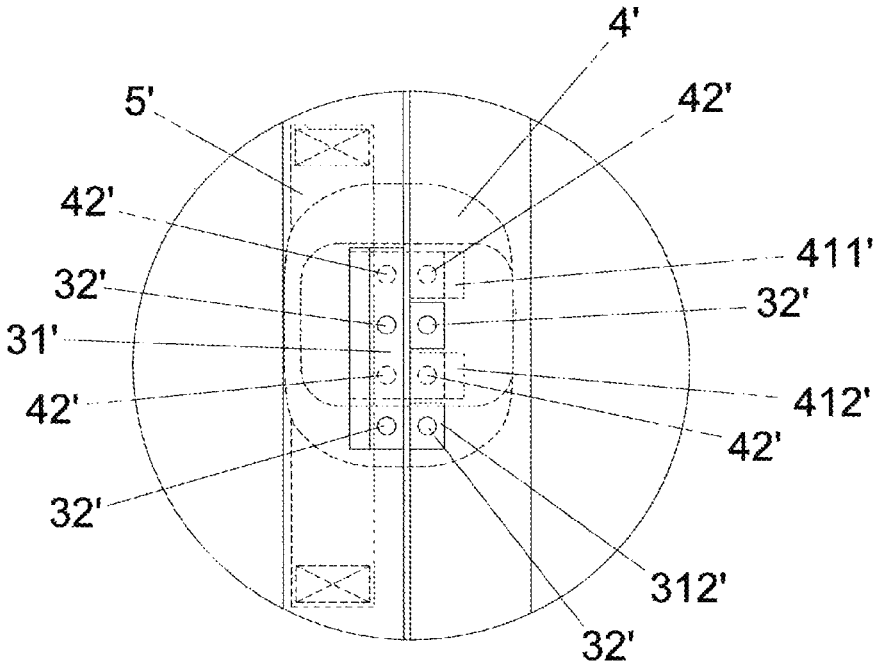
FIG. 9B is a schematic front view illustrating the hanger in accordance with another embodiment of the present invention before operation.
Figure 10:
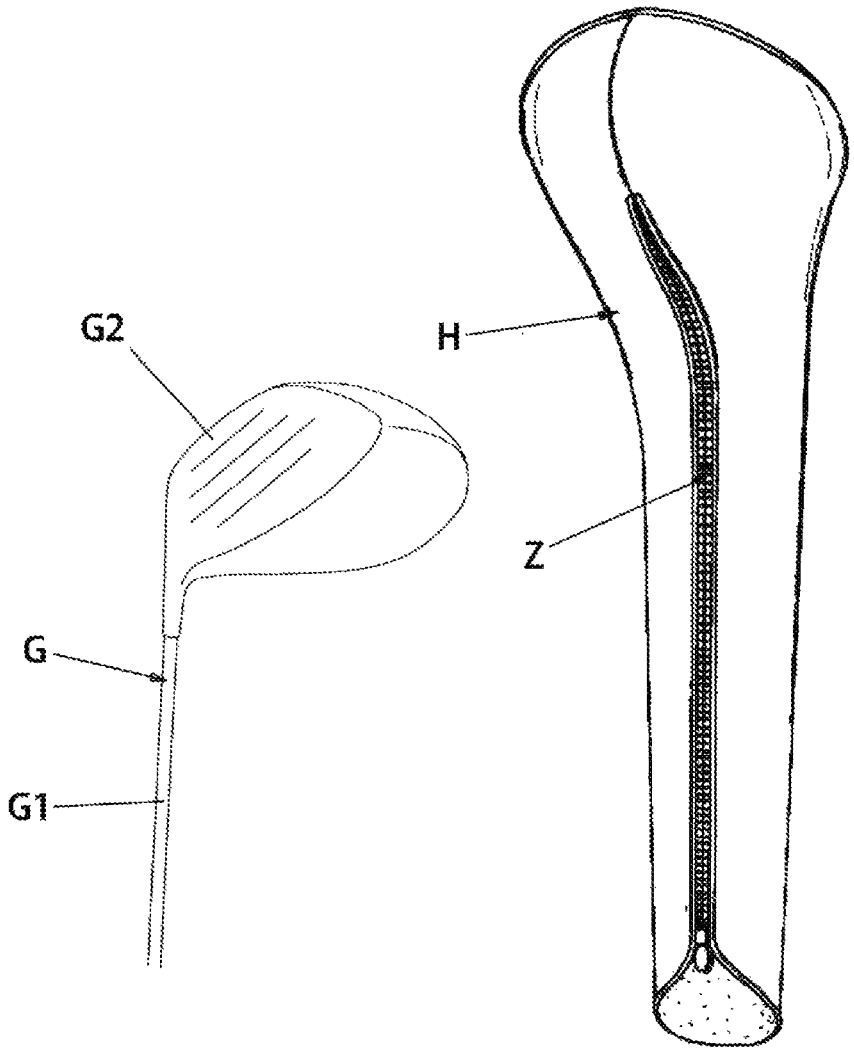
FIG. 10 is a perspective view of a conventional holder for golf clubs.

As exemplarily shown in FIG. 8, among a pair of the shape rods 3', the opening and closing protrusion 31' protrudes from the center of one shape rod 3', fixing magnets 32' are attached to the opening and closing protrusion 31', and an insertion groove 31*b*' into which the fixing protrusion 41' at one side of the hanger 4' is inserted is formed outside the opening and closing protrusion 31'. The length of the insertion groove 31*b*' is properly adjusted to function as a stopper to set the limit of lifting the hanger 4' so as to prevent the hanger 4' from being lifted more than needed.

Among a pair of the shape rods 3', the opening and closing protrusions 31' formed on the other shape rod 3' include an upper opening and closing protrusion 311' and a lower opening and closing protrusion 312' divided from each other and a separation space S1 is formed between the upper opening and closing protrusion 311' and the lower opening and closing protrusion 312'.

The fixing protrusions 41' are formed at both sides of the inner surface of the hanger 4' so as to grasp the opening and closing protrusions 31', and corresponding fixing magnets 42' corresponding to the fixing magnets 32' of the opening and closing protrusions 31' are fixed to the inner surface of the hanger 4' between the fixing protrusions 41'.

Among the fixing protrusions 41' of the hanger 4', the fixing protrusion 41' disposed at one side of the hanger 4' has a greater length than the fixing protrusions 41' disposed at the other side of the hanger 4' and is inserted into the insertion groove 31*b*' of the shape rod 3' so that the hanger 4' may slide vertically, the fixing protrusions 41' disposed at the other side of the hanger 4' include an upper fixing protrusion 411' and a lower fixing protrusions 412' divided from each other and contacting the upper opening and closing protrusion 311' and the lower opening and closing protrusion 312' of the shape rod 3' so as to grasp the upper opening and closing protrusion 311' and the lower opening and closing protrusion 312', and a separation space S2 is formed between the upper fixing protrusion 411' and the lower fixing protrusion 412'.

The hanger 4' slides vertically along the insertion groove 31*b*', separation of the hanger 4' from the holder main body 1' is prevented even in the magnetic force released state, and a guide insertion groove 44', into which a guide 5' formed on the holder main body 1' is inserted, is formed on the side surface of the hanger 4' so that the guide 5' prevents separation of the hanger 4' from the holder main body 1' during vertical sliding of the hanger 4.

In the above-described holder A' for golf clubs in accordance with this embodiment, when the hanger 4' grasping the opening and closing protrusions 31' of the shape rods 3' is pushed to slide upwards, magnetic force between the magnets is partially released, at the moment of time when, among the upper and lower fixing protrusions 411' and 412' disposed at the other side of the hanger 4' grasping the upper and lower opening and closing protrusions 311' and 312' of the shape rod 3', the lower fixing protrusion 412' is disposed in the separation space S1 between the upper opening and closing protrusion 311' and the lower opening and closing protrusion 312' and the upper opening and closing protrusion 311' moves to the separation space S2, locking of the holder A' for golf clubs is released, the opening and closing operating units of the holder main body 1' receive force acting to spread the opening and closing operating units, and the holder main body 1' is automatically opened to withdraw or insert a club head therefrom or thereinto. Further, when the opened holder main body 1' is closed, the opening and closing protrusions 31' are automatically caught by the hanger 4' by mutual attractive and repulsive force between the magnets 42' of the hanger 4' and the magnets 32' of the opening and closing protrusions 31' due to arrangement of the magnets 32' and 42' and, thus, the upper and lower fixing protrusions 411' and 412' of the hanger 4' are fixed to the upper and lower opening and closing protrusions 311' and 312' of the shape rod 3' and the closed state of the holder main body 1' is fixed, thereby allowing the holder A' for golf clubs to be conveniently opened and closed and to have a simple structure.

Although this embodiment describes that the holder main body is opened and closed by vertically sliding the hanger along the insertion groove, the disclosure is not limited thereto.

As described above, in a holder for golf clubs with a hanger in accordance with the present invention, opening and closing protrusions are formed on shape rods, fixing protrusions to grasp the opening and closing protrusions are formed on the hanger, and magnets are installed on the opening and closing protrusions and the hanger so that the hanger and the opening and closing protrusions execute the functions thereof by the opening and closing protrusions and the fixing protrusions and magnetic force between the magnets. That is, in the holder for golf clubs of the present invention, since the hanger and the opening and closing protrusions caught by the hanger are disposed at the outside of holder main body (i.e., because there is no locking device within the holder main body), the size of the holder main body may be reduced, damage to the shaft of a golf club may be prevented, and the holder for golf clubs may be easily manufactured.

The holder for golf clubs in accordance with the present invention may be repetitively manufactured in a general golf club holder manufacturing industry and be thus industrially available.

As apparent from the above description, the present invention provides a holder for golf clubs including a holder main body including cut parts divisionally formed in the longitudinal direction so as to receive a club head of a golf club and opening and closing operating units disposed within the holder main body and rotated about a hinge shaft to open and close the cut parts to the left and right and receiving force acting to spread the opening and closing operating units, opening and closing protrusions protruding upwards from the centers of the outer surfaces of the edges of the opening and closing operating units of the holder main body, contacting each other, and a hanger including fixing protrusions corresponding to the opening and closing protrusions and grasping the opening and closing protrusions so as to be detachably fixed to the opening and closing protrusions. Here, when locking between the opening and closing protrusions and the hanger fixed to the opening and closing protrusions is released, the cut parts of the holder main body receive force acting to spread the cut parts, at the moment of time when the fixing protrusions of the hanger are separated from the opening and closing protrusions, and are automatically opened to insert or withdraw a club head into or from the holder main body and, when the opened cut parts of the holder main body are closed and the fixing protrusions of the hanger are fixed to the opening and closing protrusions, the holder main body is closed. Thereby, by locking and releasing the hanger with and from the holder main body even by only one hand, the holder main body may be conveniently opened and closed and have a simple structure.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding Korean Application No. 10-2015-0062250, filed May 1, 2015 are incorporated by reference herein.

What is claimed is:

1. A holder for golf clubs having a holder main body having cut parts divisionally formed in the longitudinal direction, opening and closing operating units installed within the holder main body and opened and closed to the left and right and to receive a force acting to spread apart the cut parts, the holder for golf clubs including:

a pair of shape rods fixed to inner surfaces of the edges of the cut parts of the holder main body, the edges contacting each other, and the pair of shape rods including a pair of opening and closing protrusions protruding upwards from the centers of the shape rods; and a hanger including a pair of fixing protrusions to fix the pair of opening and closing protrusions of the shape rods and detachably fixed to the pair of opening and closing protrusions, wherein fixing magnets are fixed to each of the opening and closing protrusions; and corresponding fixing magnets are installed on the hanger so as to correspond to the fixing magnets of the opening and closing protrusions.

2. The holder for golf clubs according to claim 1, wherein an upper holder lid moving according to the opening and closing operation of the cutting parts and protecting the inside of the holder main body is installed above the cut parts of the holder main body.

3. The holder for golf clubs according to claim 2, wherein lid magnets are installed at the lower portion of the upper holder lid and operated so as to correspond to upper magnets fixed to the upper portions of the shape rods.

4. The holder for golf clubs according to claim 1, wherein, among the pair of fixing protrusions of the hanger, one fixing protrusion is defined as a support fixing protrusion having a greater length than the other fixing protrusion.

5. The holder for golf clubs according to claim 1, wherein:

an insertion groove, into which the end of the support fixing protrusion is inserted, is formed at the outside of the opening and closing protrusion of one shape rod of the pair of shape rods; and the support fixing protrusion of the hanger is inserted into and fixed in the insertion groove.

6. The holder for golf clubs according to claim 1, wherein the pair of shape rods including the opening and closing protrusions:

is detachably attached to the edges of opening and closing wings of the opening and closing operating units.

7. The holder for golf clubs according to claim 1, wherein hook and loop tapes are attached to the edges of the inner surface of the hanger and parts of the outer surface of the holder main body adjacent to the cut parts so as to detachably fix the hanger to the holder main body without separation of the hanger from the holder main body.

8. The holder for golf clubs according to claim 1, wherein the pair of shape rods including the opening and closing protrusions:

is formed integrally with the edges of the opening and closing wings of the opening and closing operating units so that the opening and closing protrusions are formed integrally with the opening and closing wings.

9. A holder for golf clubs having a holder main body having cut parts divisionally formed in the longitudinal direction, opening and closing operating units installed within the holder main body and opened and closed to the left and right and to receive a force acting to spread apart the cut parts, the holder for golf clubs including:

a pair of shape rods fixed to inner surfaces of the edges of the cut parts of the holder main body, the edges contacting each other, and the pair of shape rods including a pair of opening and closing protrusions protruding upwards from the centers of the shape rods; and a hanger including a pair of fixing protrusions to fix the pair of opening and closing protrusions of the shape rods and detachably fixed to the pair of opening and closing protrusions, the pair of fixing protrusions separated from each other is formed on the inner surface of the hanger and corresponding fixing magnets corresponding to fixing magnets on the opening and closing protrusions are fixed to the inner surface of the hanger between the fixing protrusions; and bending parts extending outwards from the fixing protrusions are formed on the outer surface of the hanger.

* * * * *